US011794205B2

(12) United States Patent
Barberan Latorre

(10) Patent No.: US 11,794,205 B2
(45) Date of Patent: Oct. 24, 2023

(54) METHOD FOR APPLYING A PRODUCT BY ROLLER AND APPLICATION SYSTEM

(71) Applicant: Jesus Francisco Barberan Latorre, Castelldefels (ES)

(72) Inventor: Jesus Francisco Barberan Latorre, Castelldefels (ES)

( * ) Notice: Subject to any disclaimer, the term of this patent is extended or adjusted under 35 U.S.C. 154(b) by 188 days.

(21) Appl. No.: 17/147,120

(22) Filed: Jan. 12, 2021

(65) Prior Publication Data

US 2021/0213484 A1 Jul. 15, 2021

(30) Foreign Application Priority Data

Jan. 14, 2020 (EP) ..... 20382016

(51) Int. Cl.

| | |
|---|---|
| ***B05C 1/08*** | (2006.01) |
| ***B05C 1/16*** | (2006.01) |
| ***B05C 1/02*** | (2006.01) |
| *B05D 1/28* | (2006.01) |

(52) U.S. Cl.

CPC ..... *B05C 1/0813* (2013.01); *B05C 1/025* (2013.01); *B05C 1/0821* (2013.01); *B05C 1/0856* (2013.01); *B05C 1/0865* (2013.01); *B05C 1/0873* (2013.01); *B05C 1/0886* (2013.01); *B05C 1/165* (2013.01); *B05D 1/28* (2013.01)

(58) Field of Classification Search

CPC ... B05C 1/0813; B05C 1/0821; B05C 1/0856; B05C 1/0873; B05C 1/165; B05C 1/0886; B05C 1/025; B05C 1/0808; B05C 1/0865; B05C 1/0895; B05D 1/28; B05D 7/26

USPC ..... 118/256

See application file for complete search history.

(56) References Cited

U.S. PATENT DOCUMENTS

| | | | | |
|---|---|---|---|---|
| 2005/0255249 | A1 | 11/2005 | Schlatterbeck et al. | |
| 2009/0229516 | A1 | 9/2009 | Sorbini et al. | |
| 2015/0338758 | A1* | 11/2015 | Numata | G03G 15/104 399/237 |

FOREIGN PATENT DOCUMENTS

| | | | |
|---|---|---|---|
| EP | 2022568 | A2 | 2/2009 |
| EP | 3556476 | A1 | 10/2019 |
| ES | 2008615 | A6 | 7/1989 |
| FR | 2445178 | A1 | 7/1980 |
| JP | S58163474 | A | 9/1983 |

OTHER PUBLICATIONS

European Search Report for Corresponding European Application No. EP 20382016 (3 Pages) (dated Aug. 19, 2020).

* cited by examiner

*Primary Examiner* — Laura Edwards

(74) *Attorney, Agent, or Firm* — LUCAS & MERCANTI, LLP

(57) ABSTRACT

A method for applying a product by roller on a surface of a substrate (112) transported horizontally with respect to an application head (111, 111') is discloses. The method includes moving the application head (111, 111') immediately from a lowered position of the application head (111, 111'), wherein the application roller (122, 122') applies the product in a predetermined position of the surface of the substrate, to a raised position of the application head (111, 111'), wherein the application roller (122, 122') does not apply product; or vice versa. An application system using the method for applying a product by roller is also disclosed.

13 Claims, 3 Drawing Sheets

METHOD FOR APPLYING A PRODUCT BY ROLLER AND APPLICATION SYSTEM

CROSS REFERENCE TO RELATED APPLICATION

This application claims the benefit of priority from European Patent Application No. 20382016.2 filed on Jan. 14, 2020, which is incorporated herein by reference.

TECHNICAL FIELD

The present invention relates to a method for applying a fluid product or material, such as a varnish or a glue, by roller on a substrate, as well as an application system.

STATE OF THE ART

The varnishing or gluing of flat surfaces of furniture and similar elements, which are mass-produced, is performed in varnishing and gluing lines. These lines are formed by several machines, each of which performs one operation of the process which has been previously selected.

The processes for varnishing flat surfaces, such as panels and/or boards of furniture and the like, are generally performed with a varnish application machine and a drying tunnel. In the same manner, the gluing of flat surfaces is performed with a gluing machine.

The application of the varnish or glue is established by means of a roller arranged on a head, and can also be performed by means of at least two combined rotating rollers, respectively.

The first roller, called the "application roller", is responsible for applying the product on the surface of the substrate by smoothing the applied product. The second roller located in the proximity of the application roller is used to dose the amount of product with which the application roller is coated for the subsequent application thereof on the substrate. The dosing is achieved by adjusting the space or gap between both rollers, as well as by adjusting the speed of both rollers. If the separation between the two increases, the amount of product dosed increases. If the rotation speed of the dosing roller increases in the direction opposite from the application roller, the amount of product dosed also increases. And if the dosing roller rotates in the same direction as the application roller, the amount of dosed product decreases.

In normal operation, the application roller rotates in the same direction as the advance of the substrate.

However, on other occasions the application roller rotates in the direction opposite from the advance of the substrate, which is called "reverse". In this case, it is possible to provide a greater amount of product on the surfaces of the substrate to be varnished. This reverse operation can occur with the application of a single application head with operation in the direction opposite from the advance of the substrate.

On other occasions, the system has two application heads. In this system, the roller of the first application head rotates according to the normal operation indicated above and the roller of the second application head works in the direction opposite from the advance of the substrate. Thus, a thin layer of product is deposited on the substrate with the first application head and subsequently, by means of the reverse application head adjacent to the previous one, a larger amount of product is applied. This produces a smoothing of the product, as well as achieving the deposition and smoothing of high-grammage varnish layers with high quality of the varnished surfaces.

This product application, and in particular when a greater contribution of product from the application roller is produced during the reverse operation, tends to deposit an excess or excessive bead of product on the front and rear edges of the substrate to be varnished or glued.

Furthermore, when the substrate hits the application roller, which rotates in the opposite direction, it takes on the edge thereof an amount of varnish which is greater than the rest, thereby creating a discontinuous finish or ridge on the leading edge or inlet edge. This ridge also appears on the trailing edge since the applied varnish overflows on the trailing edge of the substrate after the application of the varnish. This ridge cannot be eliminated and clearly stands out compared to the rest of the uniform finish.

OBJECT OF THE INVENTION

The present invention seeks to solve one or more of the problems explained previously by means of a method for applying a product by roller on the surface of a substrate transported horizontally with respect to an application head, which comprises moving the application head immediately from a lowered position of the application head, wherein the application roller applies product coinciding with a predetermined position of the surface of the substrate, to a raised position of the application head wherein the application roller does not apply product; or moving the application head immediately from a raised position of the application head to a lowered position wherein the application roller applies product coinciding with a predetermined position of the surface of the substrate. The invention also relates to the application system using said method. The product applied being able to be, for example, varnish, glue, or a fluid product.

Said lowered position corresponds to the position of the application head wherein the roller applies the product as long as it is in contact with the substrate. The lowered position is the usual position wherein the application head is located in conventional heads. Advantageously, with the present invention, the raised position could also be used as the waiting position.

Normally, the predetermined position of the surface of the substrate corresponds to a leading edge or a trailing edge. The leading edge being the starting edge of the substrate which moves closer to the application head in the movement of the substrate towards said application head, and the trailing edge being the edge corresponding to the end of the substrate according to the previous movement of the substrate.

Thus, in the case of the leading edge, the application roller moves from the raised position thereof wherein no product is applied, to the lowered position immediately, i.e., making the lowered position of the head coincide with the edge of the leading edge of the substrate, starting to apply the varnish. In this manner, the lateral impact of the varnish layer comprised in the application head against said leading edge is prevented if the head does not move.

When said predetermined position coincides with the trailing edge, the application roller is withdrawn from the position wherein the product is applied immediately to a raised position wherein it does not apply product. In this manner, product ceases to be applied, coinciding with the edge of the trailing edge. The ridge produced by the overflow of excess varnish is removed in a continuous varnish application wherein the application head is not raised.

Consequently, the ridges or accumulation of varnish at the application start and end points on the substrate coinciding with the leading and trailing edges are prevented. As an additional advantage, contamination of the transport means of the substrate is also prevented which could be produced if the substrates had a very low thickness.

The leading edge being the predetermined reference position, in this case the application roller will always come from a raised position which may have been reached moments before the leading edge of the substrate coincides with the application roller, said raised position may be the normal position of the application roller. Thus, unlike the varnishing machines of the state of the art which are continuously maintained in the lowered position, damage to the outer surface of the application head is prevented. This outer surface, commonly made of rubber, is suitable for exerting pressure on the substrate and therefore be able to smooth the varnish; therefore, in the lowered position the application head is slightly below the height at which the substrate is located. If the substrate moves without the application head moving to the raised position thereof, an impact is produced between the rubber and the leading edge which eventually deteriorates the application roller and creates defects in the application of the varnish.

According to an additional embodiment, the method for applying varnish comprises a plurality of predetermined positions of the surface of the substrate. Thanks to this configuration, discontinuous varnishing can be performed on the substrate, which offers the advantage of making reserves.

According to a feature of the invention, the application head remains in the same lowered position between consecutive predetermined positions. In other words, varnish is applied between consecutive predetermined positions, achieving continuous varnishing.

Optionally, when it is necessary to apply a higher amount of product, the application head is able to be actuated in reverse, such that the application roller applies product on the substrate in the direction opposite from the transport direction thereof towards the application head. Since, in this case, the application roller is able to apply a higher amount of varnish, due to the fact that the speeds at the contact point are in the opposite direction, and thus in a specific area of the part, there is a greater area of varnish that the roller that passes over, and the roller transfers the varnish. Thus, when it impacts the leading edge of the substrate, the generated ridge is more evident. By moving the application roller to the raised position if it is not there initially, and by immediately moving it to the lowered position coinciding with the leading edge, said defect is prevented. This reverse operation can occur when there is a single application head acting in reverse, or when there are two independent heads wherein one rotates in the direction of the movement and the other one in reverse.

Another feature of the invention is that the movement of the application head alternates between lowered positions and raised positions. Thus, the application head, which is previously in a lowered position, moves to the raised position and in the following predetermined position it moves back to the lowered position.

Preferably, according to the invention, the movement alternating between two consecutive lowered positions is immediate. "Immediate" denotes that the movement from the intermediate raised position to the consecutive lowered position occurs immediately after the movement from the preceding lowered position to the intermediate raised position.

Additionally and preferably, the period of the movement alternating between two consecutive lowered positions is less than or equal to 1.0 seconds, preferably 0.5 seconds and more preferably 0.1 seconds. This actuation speed provides greater ease in order to reduce gaps between one substrate and the next. In this case, the application roller in the initial movement thereof from the lowered position to the raised position coincides with the trailing edge of a substrate and at the end of the alternating movement it coincides in the lowered position thereof with the leading edge of the next substrate. In this manner, it is more effective for high movement speeds of the substrate. It is therefore possible to increase the productivity and quality of the final substrate.

The object of this invention is also a system for applying a product by roller on a substrate, comprising; an application head comprising an application roller; a transport device for transporting the substrate horizontally with respect to the application head; an actuator for moving the application head between a lowered and a raised position and vice versa; a position detector of the substrate with respect to the application head; and a microprocessor configured to command a method according to one of the preceding claims, receiving from the position detector a signal for detecting the position of the substrate and sending an actuation signal to the actuator in order to move the application head in a predetermined position of the substrate.

In this manner, the position of the substrate is automatically detected and with the predetermined positions introduced, the microprocessor orders the raising of the application head and the subsequent lowering thereof to the lowered position.

This system is equally valid for application heads comprising a dosing roller, which doses the amount of varnish in the interaction thereof with the application roller. In this case, the dosing roller moves jointly with the application head during the raising or lowering thereof with respect to the surface of the substrate, such that the misalignment of said dosing roller with respect to the application roller is not produced.

In particular, the actuator comprises a connecting rod and crank mechanism, wherein the connecting rod moves the application head when the crank is turned by a motor. With this, the movement alternating from the lowered position to the raised position and subsequently to the final lowered position is achieved; this movement corresponding to the complete rotation of the eccentric shaft can be performed immediately when it is required, such as in the leading edge, or in an alternating manner such as by applying bands of varnish on the substrate.

In order for the alternating movement to be as fast and exact as possible in order to prevent an incorrect application of the varnish, the actuator comprises a servomotor for rotating the crank.

With this method and the application system thereof that is easy to perform, a greater perfection and quality of the varnishing operations is achieved, with a regular layer of varnish with an application head, wherein the dosing amount of varnish depends on the nature of the very varnish, and the separation between the dosing rollers and the application rollers.

DESCRIPTION OF THE FIGURES

A more detailed explanation is given in the description that follows and which is based on the attached figures.

DETAILED DESCRIPTION OF THE INVENTION

The present invention relates, as mentioned previously, to a method for applying a product on a substrate (112) and to the system using said method.

Figure 1A:
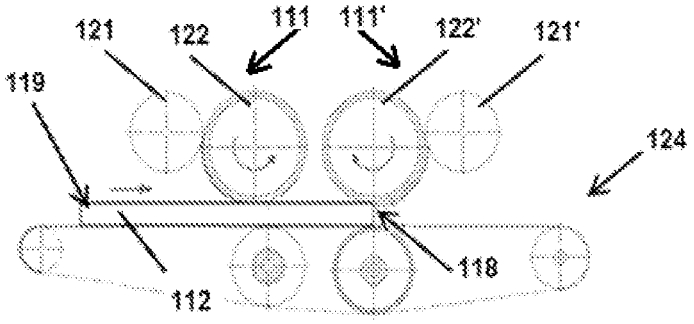
FIG. 1*a* shows a schematic profile view of a machine for applying varnish comprising two application heads, one in normal operation and the other in reverse. In this sequence for applying varnish, the moment when the application roller of the head in reverse impacts the leading edge can be seen.
Figure 1B:
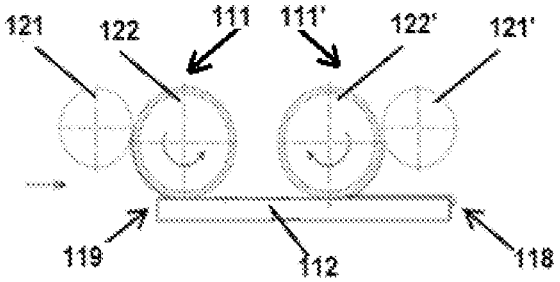
FIG. 1*b* shows the sequence for applying varnish wherein the ridge generated on the leading edge by a machine of the state of the art once varnish has been applied at the beginning of the substrate can be seen.
Figure 1C:
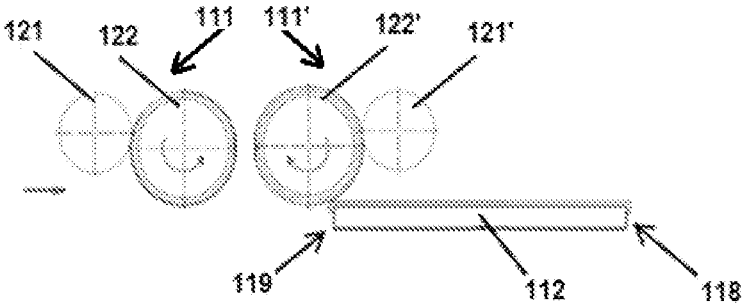
FIG. 1*c* shows the sequence for applying varnish wherein both the ridge generated on the leading edge, as well the one generated on the trailing edge by a machine of the state of the art once varnish has been applied on all of the substrate can be seen.

FIGS. 1*a*, 1*b* and 1*c* show the sequence for applying varnish of an application system corresponding to varnishing machines comprising two consecutive heads, of which in the first application head (111) the first application roller (122) rotates in the same direction as the advance of the substrate (112) and the second application head (122') rotates in reverse, i.e. in the direction opposite from the movement of the substrate (112). In this sequence, the ridge generated both on the leading edge (118) and on the trailing edge (119) of the substrate can be seen, which is produced in the varnishing machines of the state of the art. In this type of machine, the substrate (112) is transported thanks to conveyor belts or transport rollers (124).

In relation to this type of application heads (111, 111'), dosing rollers (121, 121') are arranged which, according to the rotation thereof and the gap therebetween and the applicators in the contact area therebetween, contribute larger or smaller amounts of varnish, in order to deposit it on the surface of the application roller (122, 122'). This application roller (122, 122') has an outer surface made of rubber which contributes to the adhesion of the varnish dosed by the dosing roller (121, 121').

In this method of the state of the art, the varnish is applied on the substrate (112), it staying between the application roller (122, 122') and a counter-pressure roller (123, 123') which is kept stationary with respect to the application roller (122, 122'). Therefore, a first thin layer of varnish is applied by the first application roller (122) and the corresponding counter-pressure roller (123) thereof. Next, a thicker layer of varnish is applied and the smoothing is produced by the action of the second application roller (122') which acts in the direction opposite from the advance of the substrate (112).

However, in the deposition of the varnish by both the first application roller (122) and the second application roller (122'), an accumulation of varnish is produced on the leading edge (118) and trailing edge (119) of the substrate (112). This accumulation occurs either due to excessive deposition of varnish in these predetermined areas, or due to the impact of the varnish layer adhered to the outer surface of the application roller (122, 122') when it impacts the leading edge (118) or due to the runoff of the varnish smoothed by the applicator in reverse on the trailing edge. In the latter situation, the defect produced by the accumulation of varnish is more apparent.

Therefore, the object of the invention is to remove these types of excess or ridges, which are visible on the substrate (112) of FIG. 1*c*. To do so, the system and the method for applying product of the invention are used.

Figure 2:
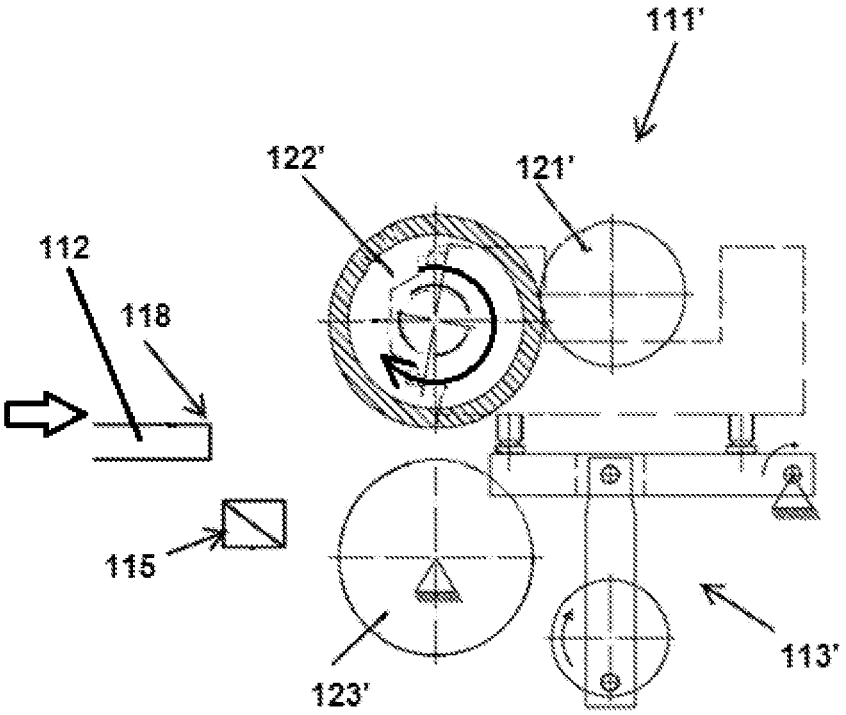
FIG. 2 shows a schematic profile view of a system for applying product with an application head comprising an application roller in reverse and with a dosing roller, at the moment when the application head is in the lowered position prior to the contact with the substrate.

FIG. 2 shows a preferred embodiment of the system for applying varnish of the invention. In this case, the application head (111') acts in reverse.

Thus, in a first moment, for the case of systems with two consecutive application heads, wherein an application head (111) acts normally and the other application head (111') acts in reverse, a position detector (115) detects the position wherein the substrate (112) is located in the horizontal movement thereof. Subsequently, a microprocessor (116) receives a detection signal of said position of the substrate (112) and sends an actuation signal to the actuator (113) in order to move the application head (111) coinciding with a predetermined position of the substrate (112).

In a preferred embodiment indicated for substrates wherein high grammages of varnish are applied, initially said predetermined position coincides with the leading edge (118) of the substrate (112). The actuator (113) receives the actuation signal and moves a first application head (111) immediately before the contact of the first application roller (122) with the leading edge (118) of the substrate (112). This initial movement is produced in the event that the application head (111) is in the usual lowered position, although it could be the case that the application head (111) was initially in the raised position.

This first roller corresponds to the application roller (122) which rotates in the same direction as the movement of the substrate (112). Together with it, the corresponding dosing roller (121) thereof also moves, both being integral to the application head (111). In order to perform this movement to the raised position, the actuator (113) comprises a connecting rod and crank mechanism. The connecting rod moves the first application head (111) from the lowered position to the raised position wherein the first application roller (122) does not apply varnish.

Figure 3:
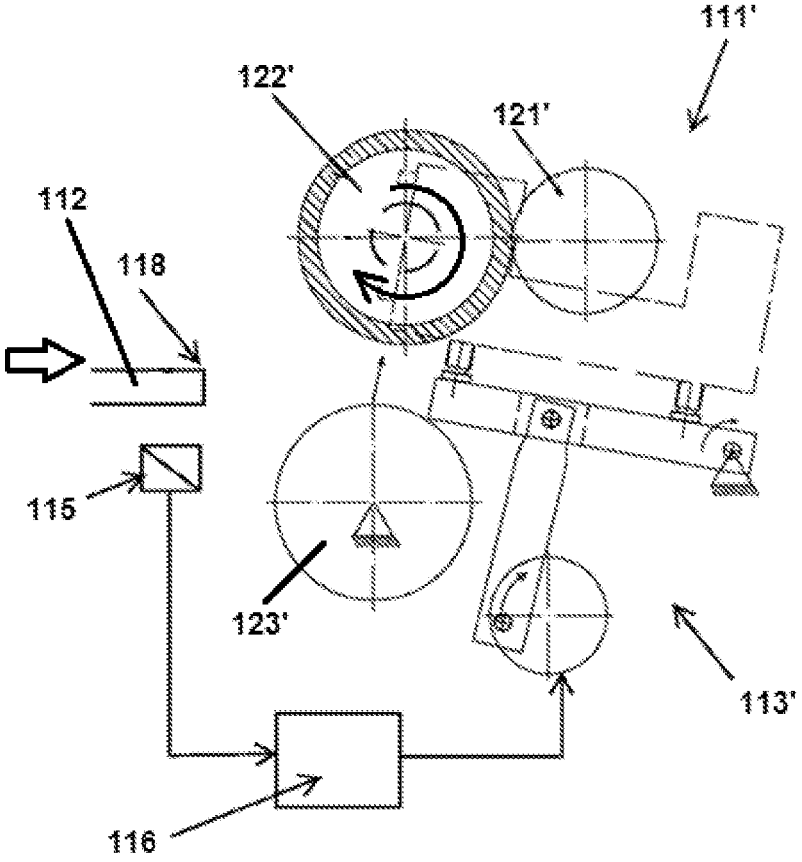
FIG. 3 shows a schematic profile view of a system for applying product with an application head in reverse, at the moment when the application head is being raised to the raised position thereof from the lowered position thereof prior to the contact with the substrate, the actuator being in the position thereof of one fourth of the alternating movement.

The operation of the connecting rod and crank mechanism (113) of the actuator is conventional. The application head (111, 111') is fastened to the bed of the machine through a rotation point, with respect to which it pivots in order to raise and lower. The raising and lowering is provided by a connecting rod fastened, on one side, to one end of the head, and on the other side to a crank, which is an eccentric shaft. By rotating the eccentric shaft, the connecting rod provides the rotation of the head, with respect to the rotation point thereof, and it is raised or lowered. Thus, in the lowered position, the eccentric shaft will be located in the position visible in FIG. 2, in order to subsequently be raised until the eccentric shaft is in the upper position of the circumference. FIG. 3 shows said shaft in an intermediate raised position prior to the upper position, wherein product is no longer applied given that there is no contact with the substrate (112).

As seen in FIG. 3, the actuator (113), and correspondingly the application head (111), is located in the mentioned intermediate raised position wherein varnish is no longer applied. Afterwards, the crank continues moving to the initial position thereof such as the one indicated in FIG. 2, in order to move the first application head (111) to the lowered position thereof. In this manner, when the leading edge (118) of the substrate is aligned with the first application roller (122), it, in a synchronised manner, is located in the lowered position in order to coincide with the edge of the leading edge (118) on top. Thus, the application of varnish by the first application roller (122) starts at that same time, preventing the formation of the ridge and also preventing the impact of the substrate (112) against the rubber of the outer surface of the application roller (122).

This movement moving from the lowered position to the raised position and back to the lowered position corresponds to a period of the alternating movement of the connecting rod and crank mechanism of the actuator (113). The period of the movement alternating between two consecutive lowered positions is preferably less than or equal to 1.0 seconds, preferably 0.5 seconds and more preferably 0.1 seconds. In this manner, an immediate movement of the application roller (122) is achieved which does not affect the movement of the substrate (112) and, therefore, the production is increased by decreasing the gap between parts and increasing the feed rate. This immediate movement is achieved thanks to a servomotor comprised in the actuator (113) in order to rotate the crank. It will be beneficial for the continuous application of varnish to several consecutive substrates, wherein that alternating movement will coincide with the movement from a lowered position of the application roller (122) coinciding with the trailing edge (119) of a substrate to a raised position, and from that raised position to a lowered position coinciding with the leading edge (118) of the following substrate (112).

Once a first thinner layer of varnish has been applied by the first application roller (122), sometimes it may be necessary to apply a second thicker layer and then smooth the varnish in order to achieve a better finish. To do so, varnish is applied with a second application roller (122') the rotation direction of which is opposite from the movement of the substrate (112) and which is called "reverse", represented in FIG. 2. Said second application roller (122') is comprised together with the corresponding dosing roller (121') thereof in a second application head (111'). In this case, each application head (111, 111') will be independent, for which reason they will act independently one after the other.

The manner of actuation is the same as with the first application head (111). Once the position of the substrate (112) has been detected, the microprocessor (116) sends an actuation signal to the actuator (113'). Said actuator (113') corresponding to the second application head (111') moves the second application head (111') from the lowered position to the raised position immediately before the second application roller (122') impacts against the leading edge (118).

The second application roller (122') moves once again from the raised position thereof wherein it does not apply varnish to the lowered position coinciding with the edge of the leading edge (118). Then, the application of the second layer of varnish and the smoothing produced by the rotation opposite from the movement of the substrate (112) by the second application roller (122') are started.

Just like with the first roller (122), the alternating movement of the actuator (113') corresponding to the second application roller (122') preferably has a period of alternating movement of less than or equal to 1.0 seconds, preferably 0.5 seconds and more preferably 0.1 seconds. Thus, an immediate movement of the second application roller (122') is achieved without affecting the movement of the substrate (112) and, therefore, the production is increased.

Next, the varnishing of the entire surface of the substrate (112) is produced until the first head (111) reaches the trailing edge (119). At this time, the microprocessor (116) receives a signal from the position detector (115) and orders the actuator (113) of the first application head (111) so that it moves to the raised position. This movement is performed immediately such that the first application roller (122) stops applying varnish and the varnish is prevented from overflowing on the trailing edge avoiding the appearance of the ridge on the trailing edge (119).

Moments later, when the second application head (111') approaches the trailing edge (119), in the same manner, the actuator (113') corresponding to the second application head (111') moves the application roller (122') to the raised position thereof at the moment that it coincides with the edge of the trailing edge (119).

The result is a varnished substrate without ridges and with an excellent finish.

If, for design reasons, it were necessary to perform a discontinuous varnish, it would proceed in the same manner. In this case, at the end of the first varnishing area the application head (111, 111') would move to the raised position in order to stop applying varnish immediately once the predetermined position wherein the substrate is free of varnish has been detected. Moreover, at the beginning of the next varnishing area, the application head (111, 111') would move to the lowered position coinciding with said varnishing starting point. In this manner, high-speed and precise varnishing is achieved by means of a system for applying product with simple manufacturing.

The invention claimed is:

1. A system for applying a product by roller on a substrate (112), comprising:

an application head (111, 111') comprising an application roller;

a transport device (124) configured to transport the substrate (112) horizontally with respect to the application head (111, 111');

an actuator (113, 113') configured to move the application head between a lowered position and a raised position;

a position detector (115) configured to detect a position of the substrate (112) with respect to the application head (111, 111'); and a microprocessor (116) configured to command a movement of the application head (111, 111') immediately from a lowered position of the application head (111, 111') in which the application roller (122, 122') applies product in a predetermined position of the surface of the substrate, to a raised position of the application head (111, 111') in which the application roller (122, 122') does not apply product, or moving the application head immediately from a raised position of the application head to a lowered position; the microprocessor (116) further configured to receive from the position detector (115) a signal for detecting the position of the substrate (112) and sending an actuation signal to the actuator (113, 113') in order to move the application head (111, 111') in the predetermined position of the substrate (112), wherein the actuator (113, 113') comprises a connecting rod and crank, wherein the rod is configured to move the application head (111, 111') when the crank is turned by a motor, corresponding to a complete rotation movement of an eccentric shaft of the connecting rod and crank.

2. The system for applying a product by roller on a substrate (112) according to claim 1, wherein the application head (111, 111') comprises a dosing roller (121, 121').

3. The system for applying a product by roller on a substrate (112) according to claim 1, wherein the actuator (113, 113') comprises a servomotor for rotating the crank.

4. The system for applying a product by roller on a substrate (112) according to claim 1, wherein the microprocessor (116) is configured to command the predetermined position of the surface of the substrate (112) corresponds to a leading edge (118) of the substrate (112) or a trailing edge (119) of the substrate (112).

5. The system for applying a product by roller on a substrate (112) according to claim 1, wherein the microprocessor (116) is configured to command a first predetermined position correspond to a leading edge (118) of the substrate (112) and a second predetermined position corresponds to a trailing edge (110) of the substrate (112).

6. The system for applying a product by roller on a substrate (112) according to claim 1, wherein the microprocessor (116) is configured to command a plurality of predetermined positions of the surface of the substrate (112).

7. The system for applying a product by roller on a substrate (112) according to claim 1, wherein the microprocessor (116) is configured to command the application head (111, 111') to stay in the same lowered position between consecutive predetermined positions.

8. The system for applying a product by roller on a substrate (112) according to claim 1, wherein the application head (111') is actuated in reverse such that the application roller (122') is configured to apply product in a direction opposite from a transport direction of the substrate (112) towards the application head (111').

9. The system for applying a product by roller on a substrate (112) according to claim 1, wherein microprocessor (116) is configured to command the movement of the application head (111, 111') is alternating between lowered positions and raised positions.

10. The system for applying a product by roller on a substrate (112) according to claim 9, wherein the microprocessor (116) is configured to command the movement alternating between two consecutive lowered positions is immediate.

11. The system for applying a product by roller on a substrate (112) according to claim 9, wherein the microprocessor (116) is configured to command the period of the movement alternating between two consecutive lowered positions is less than or equal to 1.0 seconds.

12. The system for applying a product by roller on a substrate (112) according to claim 9, wherein the microprocessor (116) is configured to command the period of the movement alternating between two consecutive lowered positions is less than or equal to 0.5 seconds.

13. The system for applying a product by roller on a substrate (112) according to claim 9, wherein the microprocessor (116) is configured to command the period of the movement alternating between two consecutive lowered positions is less than or equal to 0.1 seconds.

* * * * *